US005112685A

United States Patent [19]

Rashbrook et al.

[11] Patent Number: 5,112,685

[45] Date of Patent: May 12, 1992

[54] DRYER SCREEN MADE FROM POLY(2-METHYL-1,5-PENTYLENE) TEREPHTHALAMIDE

[75] Inventors: Robert B. Rashbrook; Clyde W. Alexander, both of Charlotte, N.C.; Edward C. Bland, Gaffney, S.C.

[73] Assignee: Hoechst Celanese Corporation, Somerville, N.J.

[21] Appl. No.: 653,825

[22] Filed: Feb. 11, 1991

[51] Int. Cl.[5] ..... D02G 3/00

[52] U.S. Cl. ..... 428/364; 428/224; 528/347; 528/349; 139/383 A; 162/348

[58] Field of Search ..... 528/347, 335, 349; 139/383 A; 162/348; 428/364, 224

[56] References Cited

U.S. PATENT DOCUMENTS

| | | | |
|---|---|---|---|
| 4,093,512 | 6/1978 | Fleisher | 162/348 |
| 4,163,101 | 7/1979 | Schade et al. | 528/347 |
| 4,423,755 | 1/1984 | Thompson | 139/383 A |
| 4,452,284 | 6/1984 | Eckstein et al. | 139/383 A |
| 4,465,821 | 8/1984 | Nielinger et al. | 528/335 |
| 4,559,975 | 12/1985 | Stits | 428/224 |
| 4,749,611 | 6/1988 | Furuya | 428/364 |
| 4,789,009 | 12/1988 | Troughton | 139/383 A |
| 4,937,315 | 6/1990 | Barthelemy | 528/347 |
| 4,937,322 | 6/1990 | Barthelemy | 528/347 |
| 4,991,630 | 2/1991 | Penven | 428/224 |
| 5,052,448 | 10/1991 | Givin | 139/383 A |
| 5,053,109 | 10/1991 | Penven | 162/348 |

FOREIGN PATENT DOCUMENTS 19551 8/1969 Japan .

*Primary Examiner*—Ellis P. Robinson
*Assistant Examiner*—N. Edwards
*Attorney, Agent, or Firm*—Robert H. Hammer, III

[57] ABSTRACT

Poly(2-methyl-1,5-pentylene) terephthalamide is discussed herein. It is manufactured in a process starting with a nylon salt made from terephthalic acid and 2-methyl-1,5-pentylene diamine and an excess amount of the diamine. The polymer is spun to form monofilaments. The monofilaments may be used, among other things, to form dryer screens for use in a paper forming process.

3 Claims, No Drawings

DRYER SCREEN MADE FROM POLY(2-METHYL-1,5-PENTYLENE) TEREPHTHALAMIDE

FIELD OF THE INVENTION

This invention is directed to: a method of using poly(2-methyl-1,5-pentylene) terephthalamide monofilaments; a method of spinning those monofilaments; and a process for making that polymer.

BACKGROUND OF THE INVENTION

Screens used in the papermaking process, for example dryer screens, are subject to the harsh chemical environment of the papermaking process. Accordingly, such screens are degraded in relatively short periods of time as a result of hydrolytic attack. This causes screen failure and requires frequent replacement of the screen, which results in down time, i.e., increased operating costs, to the paper manufacturer.

Dryer screens currently in use are made predominantly of polyethylene terephthalate (PET). PET is a good material, but improvements can be made. To this end, some manufacturers of materials for papermaking dryer screens have investigated the use of polyphenylene sulfide (PPS) monofilaments. For example, see U.S. Pat. Nos. 4,610,916; 4,748,077; and 4,801,492. While these patents disclose PPS monofilaments which, when compared to PET monofilaments for the same end use, show some performance advantages, the cost of the dryer screens produced from that material is significantly higher.

Accordingly, the search for improved materials that can be used in the manufacture of papermaking dryer screens, among other things, continues. Disclosed hereinafter is a material, poly(2-methyl-1,5-pentylene) terephthalamide, which has good resistance to hydrolytic attack, can be formed into monofilaments, and which is less expensive than PPS monofilaments.

Poly (2-methyl-1,5-pentylene) terephthalamide is known. See U.S. Pat. No. 4,163,101 and Japanese Kokoku No. 19551 (1969). Poly (2-methyl-1,5-pentylene) terephthalamide is also referred to as: 2-methyl pentamethylene terephthalamide; methyl pentamethylene terephthalamide; and M5T.

It is generally known that polyamides may be made from aqueous nylon salt solutions by heating the solution to a temperature from 210° C. to 220° C. and to a pressure of about 18 bars, thereby producing a low molecular weight precondensate. Thereafter, the pressure on the precondensate is lowered and the temperature simultaneously increased to about 270° C. until the desired molecular weight is achieved. See U.S. Pat. No. 4,465,821.

Japanese Kokoku No. 19551 (1969) is directed to a high-elasticity polyamide produced from terephthalic acid and methyl pentamethylene diamine. The polyamide is produced by combining 50 grams of the nylon salt derived from 2-methyl pentamethylene diamine and terephthalic acid with 2.5 cc of water in a test tube. The atmosphere of the test tube is substituted with oxygen and the tube is sealed. Then, the contents of the tube are heated at 230° C. for 4 hours. The resulting reaction product is then immersed in 50 cc of distilled water for over 2 hours and, thereafter, suction-filtered and dried. Finally, the dried, filtered reaction product is polymerized at 285°-290° C. at normal pressures for over one hour, and then at a reduced pressure (3 mm Hg) for over 2 hours. This material has a relative viscosity of 2.58 (in 98% sulfuric acid). The reaction product, when directly polymerized has a relative viscosity of 1.61. This process, however, has been characterized as impractical in an economical sense because of its complexity and its relatively low production yield. See U.S. Pat. No. 4,163,101.

U.S. Pat. No. 4,163,101 is directed to a process for making polyamides, particularly such polyamides as poly (2-methyl pentamethylene terephthalamide). In this process, an aqueous solution of the nylon salt and water soluble, low molecular weight oligoamides is heated from 130° C. -150° C. to the polycondensation temperature of 250° C. to 300° C. at normal (atmospheric) pressure. The aqueous solution of nylon salt and oligoamides is produced by reacting equivalent amounts of dimethyl terephthalate (DMT) with an alkylpentamethylene diamine, such as 2-methylpentamethylene diamine, in the presence of 45 to 100 parts of water per 100 parts of DMT at 90°-$\phi$° C. over a period of 5 to 10 hours while distilling out the methanol by-product.

U.S. Pat. No. 4,465,821 is directed to a continuous, normal (atmospheric) pressure process for the production of polyamides, but the production of poly(2-methyl-1,5-pentylene) terephthalamide is not disclosed. In this process, an aqueous solution of the nylon salts derived from equal molar amounts of diamines and dicarboxylic acids is continuously introduced into the precondensate melt of the resultant polyamide. This precondensate melt is maintained at atmospheric pressure and at a temperature of at least 180° C. while water is continuously distilled away.

SUMMARY OF THE INVENTION

Monofilaments made from the M5T polymer would be particularly suited for manufacture of dryer screens used in the papermaking process. This is due to the hydrolytic stability and good tensile properties of the polymer when compared to PET monofilaments. Accordingly, a process for making M5T polymer with a suitable viscosity for spinning, a method of spinning M5T polymer into monofilaments, and the use of such monofilaments in dryer screens shall be disclosed.

A process for producing poly(2-methyl-1,5-pentylene) terephthalamide comprising the steps of: providing an aqueous solution of a nylon salt produced from terephthalic acid and 2-methyl-1,5-pentylene diamine; adding a molar excess of about 3% to about 16% of said diamine to said solution, thereby forming a mixture; heating said mixture to a pressure of about 250 psig; maintaining said mixture at said pressure while simultaneously bleeding a reaction by-product of steam therefrom; and reducing said pressure after substantially all said steam has been removed from said mixture.

A method of spinning a monofilament of poly(2-methyl-1,5-pentylene) terephthalamide comprising the steps of: providing a poly(2-methyl-1,5-pentylene) terephthalamide polymer having a solution viscosity, in dichloroacetic acid, of greater than 700; melting said polymer; extruding said polymer into a strand; air quenching said strand; and, thereafter, winding-up said strand.

A monofilament comprising poly(2-methyl-1,5-pentylene) terephthalamide.

A fabric comprising monofilaments of poly(2-methyl-1,5pentylene) terephthalamide, and the dryer screen for the papermaking process made from that fabric.

DETAILED DESCRIPTION OF THE INVENTION

The term "monofilament", as used herein, shall refer to any single filament of a manufactured fiber, usually of a denier higher than 14.

Hereafter the following is disclosed: a process for making M5T polymer; a method of spinning the molten polymer into monofilaments; and a papermaking dryer screen made with M5T monofilaments.

M5T polymer suitable for spinning must have a solution viscosity (SV) of greater than 700. (Unless otherwise indicated all SV's referred to herein are based on the use of dichloroacetic acid.) Preferably, the SV ranges between about 800 and about 950. SV's greater than 950 can be produced, but the gain in physical properties may taper off. SV's below 700 produce a polymer which is too brittle for spinning. The melting temperature of the M5T polymer in the above SV range is about 282° C. and the glass transition temperature (Tg) is about 150° C.

The polymerization of M5T polymer is considerably more difficult than that of nylon 66. This was evident when a batch of nylon 66 was made as part of commissioning trials of a 1 liter pressure reactor. The SV of the nylon 66 batch was 1233. Under the same conditions, the SV's of the M5T batches were in the range of 400–450. The difficulty appeared to be due to 1) the greater volatility of the diamine, as compared to the hexamethylene diamine and/or 2) the cyclization of the 2-methyl-1,5-pentylene diamine to 3-methyl piperidine.

To overcome this problem of low SV's for M5T polymer, it was discovered that by the addition of a molar excess of the 2-methyl-1,5-pentylene diamine over the terephthalic acid, the SV of the polymer could be increased. The use of a 3% molar excess of diamine produced an SV of about 490; an 8% molar excess, an SV of about 819; and a 10% molar excess, an SV of about 784. Preferably, the molar excess of the 2-methyl-1,5-pentylene diamine should be within the range of about 8–16%.

With the foregoing in mind, the process for making the M5T polymer starts with a nylon salt produced from terephthalic acid and 2-methyl-1,5-pentylene diamine. The formation of such nylon salts are well known to those of ordinary skill in the art. This salt is solvated to form a 50% weight aqueous solution. A 3–16% molar excess (preferably 8–16%) of the diamine is then added to the aqueous solution of the nylon salt to form an aqueous mixture of nylon salt and excess diamine. This mixture is heated in a pressure vessel to a pressure of about 250 psig. The pressure is maintained while steam, the principal reaction by-product, is continuously bled from the vessel. When substantially all the steam is removed from the vessel and the pressure in the vessel is reduced, e.g., to the atmospheric (normal) pressure, the polymerization is complete.

If the SV of the polymer is not sufficient, it may be increased by solid state polymerization (SSP). Any SSP method could be used, for example, autoclaving, at about 260° C. and under vacuum (e.g., $<1$ mm Hg) or a stream of inert gas (e.g., $N_2$), until the desired SV is obtained.

Spinning M5T polymer presents a severe problem that may be due to differential skin/core shrinkage. In conventional monofilament spinning, strands because of their high deniers are usually quenched in a liquid bath, most often water. When the M5T polymer was spun in a conventional manner, voids formed in the strand that precluded subsequent drawing of the monofilaments. These voids most likely occurred as a result of differential skin/core shrinkage rates. The differential skin/core shrinkage rates may be caused by the relatively high Tg of the polymer and/or the relatively large volume changes on the transition from liquid to solid states.

Quenching baths of glycol/water at 95° C. are no better than the water baths initially used. Quenching baths of 100% glycerol (or suitable high boiling liquids) at a temperature above 100° C. may work, but they are not preferred for safety reasons. Quenching with air (i.e., not forced air) produced relatively thin strands with acceptable void levels, but production rates appear commercially unattractive. Quenching with forced air (at 25° C., from an annular quench ring being 7 mm high, 50 mm outer diameter, 11 mm inner diameter (upper), 13 mm inner diameter (lower), and having 32 equally spaced 0.3 mm diameter holes about the annular surface, with an air pressure less than 115 psig) produced excellent results. Preferably the quench ring is located 15–17.5 cm below the spinneret face. Strands of up to 1 mm in diameter have been produced. The upper limit is apparently due equipment restraints that impact on strand rigidity and not air quenching.

The spun monofilaments can be drawn in a conventional manner. Using roll temperatures between 158° to 168°, draw ratios of up to 6:1 may be obtained. Highly drawn monofilaments may obtain physical properties as follows: initial modulus up to about 56 gram/denier; tenacity up to about 5.1 grams/denier; % elongation to break of about 12%; and relative elongation of about 6.7. The use of a spin/draw process is preferred to attain maximum physical properties.

Hydrolysis testing of the M5T monofilament and comparison to PET shows that M5T monofilaments are vastly superior to PET monofilaments. PET controls, stabilized with carbodiimide, failed within 14 days, while M5T monofilaments showed no strength loss after 24 days. Tests showed, however, that M5T monofilaments produced at a draw ratio of 4:1 or lower and not heat set showed immediate embrittlement and failed.

M5T monofilaments can be woven into fabrics as will be discussed hereinafter.

The fabric referred to herein may be formed by weaving two filament systems, i.e., lengthwise yarn (warp) and crosswise yarn (fill), at least one of which is a monofilament system, in a repeated pattern. Possible patterns include the plain weave in which the filling yarn passes alternately over and under each warp yarn, the twill weave which is formed by interlacing warp and fill so that the filling yarns are on the face rather than on the inside of the fabric. Variations of these patterns are possible which include combinations of the basic patterns, in addition to the foregoing one layer fabrics, fabrics can be woven having two or more layers. Further still, spiral fabrics of the type described in U.S. Pat. No. 4,423,543 can be manufactured.

As will be appreciated by those skilled in the art, fabrics can be woven flat and then seamed to form an endless belt or can be woven as an endless belt so that no seam is necessary. It is to be understood that the monofilament of this invention can be used for part or all of the filaments in any of the fabrics described hereinabove.

One suggested use for the fabrics of the present invention is in the paper industry where fabrics were originally made from metal wires. Metal wire fabrics have been largely replaced by fabrics made from synthetic materials. This replacement results in longer lifetimes for the belts. In some environments, i.e., where high temperatures and corrosive chemicals are present, the ordinary synthetics are not suitable.

The known fabrics described hereinabove may be used for the most part on paper forming machines, in these instances, the fabrics are formed into endless belts which are in continuous motion on the paper machine as the paper is formed. It is to be understood that such fabrics also have applications for filter media in situations where the fabric is stationary. The fabrics described in the present invention are prepared from filaments with diameters ranging from 8 mils to 40 mils and have dimensions ranging from 100 to 400 inches wide (254 to 1016 cm) and from 100 to 300 feet long (30.5 to 91.5 m). As indicated above, part of the fabric can comprise the novel monofilament, as warp of fill, or the fabric can be totally manufactured from the novel monofilament (warp and fill). Fabrics of this invention can be utilized on paper forming machines, as filter media and other applications.

The present invention can be more fully understood by reference to the following examples. These examples further illustrate the invention, but are in no way limiting upon the disclosure of the invention set forth hereinafter.

With regard to physical property test results referred to hereinafter, the tensile measurement (initial modulus, tenacity, % elongation, and relative elongation) were obtained by the use of an Instron, 4200 Series, Series IX Automated Materials Testing System v4.09a, with a gauge length of 100 mm, a strain rate of 100%/minute, sample rate of 20.00 pts./sec., crosshead speed of 100.00 mm/minute, humidity of 60%, and temperature of 73° F. The solution viscosity (SV) was measured using a Schott Instrument "Automatic SV Drop Time Measurement" device. About 0.180 to 0.220 grams of polymer are dissolved in sufficient dichloroacetic acid to form a 1% by weight solution. The drop time is measured, this is divided by the drop time of the pure solution to obtain the relative viscosity (RV). The SV is calculated as follows $(RV-1.000)\times 1000 = SV$.

EXAMPLES

Example 1

188 grams of 2-methyl-1,5-pentylene diamine (1.62 moles of the diamine, corresponding to about an 8% excess of diamine) were dissolved in 430 grams water. 2-methyl-1,5-pentylene diamine is commercially available under the trade name "DYTEK[198] A" from the DuPont Company, Petrochemical Department, Wilmington, DE. 249 grams (1.5 moles) of terephthalic acid (TA) were added slowly with vigorous stirring and gentle heating. A small drop of anti-foam B was added to the solution which was then transferred to a 1-liter stainless reaction vessel. The reactor was purged with nitrogen, then closed off and heated until the internal pressure reached 250 pounds per square inch gauge (psig). At this point, the batch temperature was 218° C. A bleed valve was then opened and steam was then bled off, so as to keep the pressure at 250 psig. After 22 minutes, when the batch temperature had reached 230° C. and 300 ml. of water had been collected, the pressure was gradually reduced to atmospheric pressure over 35 minutes. The batch was held for a further 30 minutes under nitrogen during which time the temperature rose from 270° to 294° C. The polymer was then cooled and removed from the reactor. The solution viscosity (SV), in dichloroacetic acid, was 789.

Example 2

M5T polymer was made according to the procedure set forth in Example 1. A molar excess of the diamine, DTEK ™ A, was added to determine its effect on the solution viscosity (SV) of the polymer. The results are set forth in Table 1.

TABLE 1

| Mole Percent Excess of 2-methyl-1,5-pentylene diamine | Polymer SV |
|---|---|
| 3.0 | 490 |
| 4.0 | 552 |
| 5.0 | 609 |
| 7.0 | 720 |
| 8.0 | 819 |
| 10.0 | 784 |

Example 3

68.8 kilograms of 50% aqueous solution of M5T salt solution, together with 1.4 kilograms of 2-methyl-1,5-pentylene diamine (corresponding to about a 10% molar excess of diamine) was charged to a 120 liter pressure vessel fitted with an agitator, a column, and a pressure control valve. The vessel's jacket temperature was 200° C. This vessel was purged with nitrogen and then the pressure control valve was closed. The agitator was started and the vessel heated until the contents' temperature reached 224° C. At this point, the pressure in the vessel reached 250 psig. The pressure control valve was carefully opened, so as to bleed off steam and maintain the pressure at 250 psig. After 110 minutes, when the contents' temperature was 267° C. and the pressure had fallen to 244 psig, the valve was controlled so as to reduce the pressure to atmospheric over a period of 60 minutes. The temperature in the vessel was then 293° C. As soon as atmospheric pressure was reached, the column was then isolated and the pressure in the vessel reduced to 120 mm Hg over a period of 7 minutes. The agitator was then stopped and the vessel pressured up with nitrogen. The M5T polymer was then extruded using 8 psig nitrogen. The polymer was straw colored, with no lumps and no bubbles. The yield of the polymer (SV 665) was 25 kilograms.

Example 4

M5T polymer, produced in the same manner as set forth in Example 3, was solid state polymerized at 260° C. for 6 hours to an SV of 918. The polymer was extruded using a 1 inch Killion extruder under the following conditions:

Ext temperatures: zone 1-270° C ; zone 2-290° C.; zone 3-290° C.
Melt pump temperature: 280° C.
Spinning pack temperature: 275° C.;
Spinning pack through put: 22 grams per minute; and
Wind-up speed: 19 meters per minute A forced-air ring quench unit was fitted 15 centimeters below the spinneret face, so as to cool the strand sufficiently to make it handleable. The forced air emanated from an annular quench ring (being 7 mm high, 50 mm outer diameter, 11 mm inner diameter (upper), 13 mm inner diameter (lower), and having 32 equally spaced 0.3 mm diameter holes about the annular surface with an air pressure less than 115 psig). The air's temperature was 25° C. The strand was passed through the unit and around a guide set vertically beneath it. From there it passed to a driven godet which controlled the wind-up speed. The strand was free of voids.

Example 5

Freshly made strands, produced in the manner set forth in Example 4, were drawn into monofilaments using a Petty draw frame fitted with rolls 8" long and 6" in diameter. The strand was passed around a feed roll, to a hot roll then to a draw roll, and finally to wind-up. With the hot roll at between 158° C. and 168° C., draw ratios from 4:1 to 6:1 could be achieved. The tensile properties of various monofilaments produced a different draw temperature and draw ratios are set forth in Table 2.

TABLE 2

| Sample No. % | Roll temp °C. | Draw Ratio | Denier | In Mod[1] g/den | Tenacity g/den | % Elongation to break | Rel E[2] |
|---|---|---|---|---|---|---|---|
| 1 | 168 | 4:1 | 2598 | 36 | 2.0 | 32 | — |
| 2 | " | 5:1 | 2054 | 43 | 3.1 | 17 | 13 |
| 3 | " | 6:1 | 1690 | 56 | 4.9 | 10 | 6.2 |
| 4 | 162 | 4:1 | 2368 | 36 | 1.8 | 29 | — |
| 5 | " | 5:1 | 2007 | 43 | 3.0 | 21 | 16.5 |

TABLE 2-continued

| Sample No. % | Roll temp °C. | Draw Ratio | Denier | In Mod[1] g/den | Tenacity g/den | % Elongation to break | Rel E[2] |
|---|---|---|---|---|---|---|---|
| 6 | " | 6:1 | 1768 | 55 | 5.1 | 12 | 6.7 |

[1]In Mod = Initial modulus
[2]Rel E = Relative elongation

Example 6

Samples of M5T monofilament were tested for hydrolytic stability. Samples were heated to 121° C. in a water filled pressure vessel. Samples were withdrawn every few days and the retained strength was measured. The M5T samples were not heat set. The denier of M5T samples are not corrected for shrinkage, which may account for the apparent strength increase. M5T samples drawn with a 4:1 drawn ratio showed immediate embrittlement, which may be due to excessive shrinkage. The PET controls are stabilized with carbodiimide. The results are set forth in Table 3.

TABLE 3

| | Day | | | | | | | | | |
|---|---|---|---|---|---|---|---|---|---|---|
| | 0 | 4 | 7 | 10 | 12 | 14 | 16 | 17 | 20 | 24 |
| Sample | % strength retained | | | | | | | | | |
| PET Control 1 | — | 96 | 90 | 28 | 13 | Failure | — | — | — | — |
| PET Control 2 | — | 97 | 93 | 54 | 35 | Failure | — | — | — | — |
| PET Control 3 | — | 97 | 92 | 53 | 19 | Failure | — | — | — | — |
| M5T-1 DR* 4:1 | 100 | 0 | 25 | 0 | 0 | 0 | 0 | — | — | — |
| M5T-2 DR* 5:1 | 100 | 103 | 103 | 111 | 116 | 97 | 133 | — | — | — |
| M5T-3 DR* 5:1 | — | 98 | 105 | 122 | 123 | 119 | — | 115 | 117 | 117 |
| M5T-4 DR* 6:1 | — | 109 | 118 | 117 | 112 | 122 | — | 117 | 117 | 116 |

*DR = Draw ratio

The present invention may be embodied in other specific forms without departing from the spirit or essential attributes thereof and, accordingly, reference should be made to the appended claims, rather than to the foregoing specification, as indicating the scope of the invention.

We claim:

1. A dryer screen comprising a fabric comprising poly(2-methyl-1,5-pentylene) terephthalamide monofilaments having a solution viscosity of greater than 700 and having a diameter of 8 to 40 mils.

2. The dryer screen according to claim 1 wherein said fabric is in the form of a endless loop.

3. The dryer screen according to claim 1 wherein said fabric has dimensions ranging from about 100 to about 400 inches in width and ranging from about 100 to about 300 feet in length.

* * * * *

UNITED STATES PATENT AND TRADEMARK OFFICE

CERTIFICATE OF CORRECTION

PATENT NO. : 5,112,685

DATED : May 12, 1992

INVENTOR(S) : Robert B. Rashbrook

It is certified that error appears in the above-identified patent and that said Letters Patent is hereby corrected as shown below:

Title Page:

Item [75] Inventors, delete Clyde W. Alexander and Edward C. Bland.

Signed and Sealed this

Sixth Day of July, 1993

*Attest:*

Michael K. Kirk

MICHAEL K. KIRK

*Attesting Officer*

*Acting Commissioner of Patents and Trademarks*